United States Patent [19]

Wankel

[11] 4,207,830

[45] Jun. 17, 1980

[54] WATER FOIL

[76] Inventor: Felix Wankel, Fraunhoferstr. 10, 899 Lindau (B), Fed. Rep. of Germany

[21] Appl. No.: 835,046

[22] Filed: Sep. 21, 1977

Related U.S. Application Data

[63] Continuation-in-part of Ser. No. 588,519, Jun. 19, 1975, abandoned.

[30] Foreign Application Priority Data

Jun. 20, 1974 [DE] Fed. Rep. of Germany ..... 2429669
Aug. 20, 1974 [DE] Fed. Rep. of Germany ..... 2439822

[51] Int. Cl.[2] ..... B63B 1/24
[52] U.S. Cl. ..... 114/274
[58] Field of Search ..... 114/271-292; 115/70

[56] References Cited

U.S. PATENT DOCUMENTS

| | | | |
|---|---|---|---|
| 1,630,623 | 5/1927 | Ludasy | 114/273 |
| 1,875,344 | 9/1932 | Kloen | 114/285 |
| 3,760,756 | 9/1973 | Boden | 114/289 |

*Primary Examiner*—Charles E. Frankfort
*Assistant Examiner*—Jesus D. Sotelo
*Attorney, Agent, or Firm*—Becker & Becker, Inc.

[57] ABSTRACT

A sliding boat having supporting members respectively connected to opposite sides of the hull and projecting therefrom in cantilever fashion while carrying a plurality of water sliding foils at the free end of said supporting members. Each of the sliding foils comprises a plurality of relatively long and narrow strips extending in the longitudinal direction of the boat and being spaced from each other in the transverse direction of the strips so as to form a gap there between.

4 Claims, 5 Drawing Figures

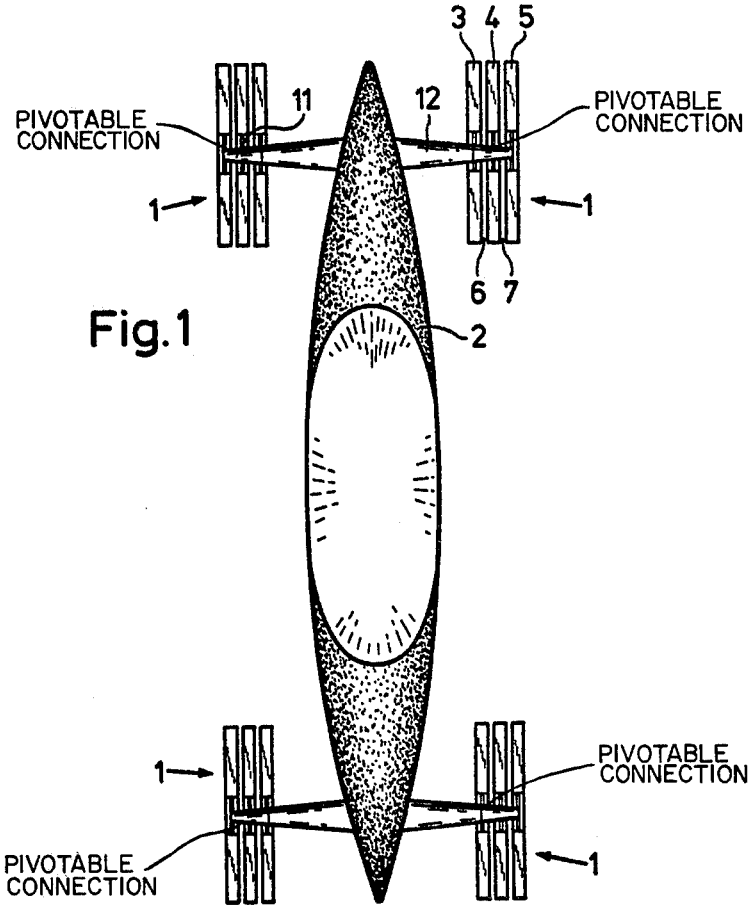
Fig. 1
Fig. 2
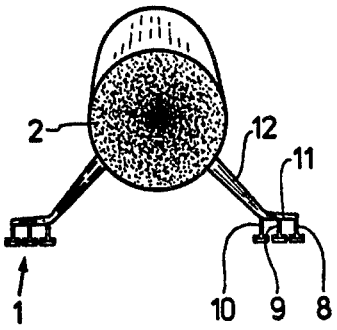

WATER FOIL

This is a continuation-in-part of co-pending application Ser. No. 588,519-Wankel filed June 19, 1975 now abandoned.

The present invention relates to a water foil for boats with sliding foils. The purpose of such water foils consists in lifting the boat out of the water during its drive to carry it above the water surface in order to reduce the displacement work and the water resistance of the hull of the boat. The sliding surfaces or water foils may be formed by surfaces of the hull itself or may be fin-shaped or wing-shaped parts spaced from the hull. Such fin or wing-like parts, in contrasts to supporting wings around which the water flows on all sides, have only their bottom side resting on the water. These water foils in addition to having a reduced water resistance have the advantage that they are not subjected to the danger of cavitation, inasmuch as they do not have an under-pressure area. Therefore, very high driving speeds are possible. However, the drawback is encountered that even slight waves may cause such hard shocks that they will be intolerable at high speeds for the boat's occupants. This drawback is particularly great when sliding surfaces of wide span and short extension in the driving direction are involved. Also, the inversed form of the sliding surfaces in the driving direction as it is employed, for instance, with water skis in which the extension in the driving direction is great and the width transverse to the driving direction is short still brings about shock stresses although to a lesser extent when driving upon waves.

There has furthermore become known a hull with longitudinally extending sliding surfaces or water foils of V-shaped cross section which in transverse direction to the driving direction are located adjacent to each other while forming a step with each other. While such boats are markedly less sensitive than sliding boats with flat hull cross sections with regard to shocks caused by waves, also this type of boat will at higher speed and when encountering waves quickly reach the limit where the shocks become unbearable.

It is, therefore, an object of the present invention to provide a boat with water foils in which the sensitivity with regard to the height of the waves will be considerably reduced.

These and other objects and advantages of the invention will appear more clearly from the following specification, in connection with the accompanying drawings, in which:

FIG. 1 is a top view of a boat according to the present invention.

FIG. 2 is the front view of the boat according to FIG. 1.

Figure 3:
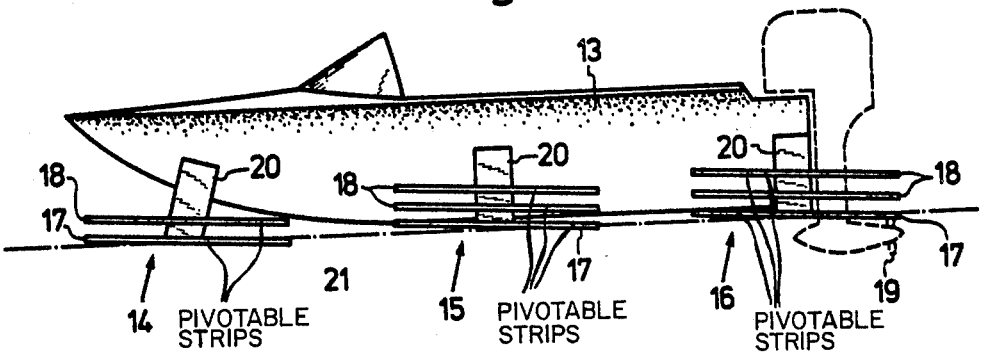
FIG. 3 is a side view of a modified boat according to the invention.

The water foil according to the present invention is characterized in that its sliding surface stands off and that it is composed of a plurality of narrow sliding strips which extend with their longitudinal axes in the driving direction while likewise standing off, said sliding strips leaving gaps between each other in the driving direction so that a grate-like structure is formed. This arrangement makes it possible when shock waves occur to permit the water quickly to flow off laterally and also makes possible a quick reduction of the water pressure which causes the hard shocks.

The sliding strips may be resiliently designed. It is furthermore suggested to interconnect the sliding strips by means of a short supporting part extending in the driving direction, while the connection of the sliding strips to the supporting part is effected by means of spacer webs which are narrow in driving direction.

These features bring about that each sliding strip will adapt itself to the movement of the waves and can swing freely and that the connections between the sliding strips and with the hull of the boat will when flooding the sliding strips offer the water a minimum of resistance.

Referring now to the drawings in detail, and FIGS. 1 and 2 thereof in particular, the four sliding foils or sliding surfaces 1 of the boat 2 are arranged in a grate-like manner and divided in driving direction into individual sliding strips 3, 4, 5 between which longitudinal gaps 6, 7 remain. Each sliding strip forms a relatively long and narrow strip having its longitudinal axis extending in the driving direction of the boat. The sliding strips are at their center portion by means of short spacer webs 8, 9, 10 connected to a supporting member 11. Each supporting member is rigid or in order to adjust the angle in inclination of said sliding surfaces is connected to the supporting arm 12 so as to be pivotable about its longitudinal axis, said supporting arm 12 carrying the hull of the boat 2.

The sliding strips are made of elastic material. Their connection at the central portion of the said strips brings about that they can spring along their entire extension. This brings about an additional softness of the driving behavior of the boat when waves impact upon the boat or the sliding foils or when the sliding foils enter a relatively deep wave valley. The sliding strips 3, 4, 5 will in this way be able to adapt themselves to the surface of the waves independently of each other and the sliding surface thus no longer represents a rigid structure. Furthermore when impacting upon the water surface, the sliding strips, by bending, temporarily form a steeper angle of attack whereby the strips are prevented from, so-to-speak, boring themselves into the water surface.

For an unimpeded action, as far as possible, of the longitudinal gaps 6, 7 as well as for the spring behavior of the individual sliding strips 3, 4, 5, it is advantageous to connect the sliding strips with each other by means of a supporting member 11 which is short in the driving direction. Furthermore, it is advantageous to effect the connection between said supporting member and the sliding strips only by means of narrow spacer webs 8, 9, 10 which offer only slight resistance in the driving direction of the boat. Merely by way of example, it may be mentioned that with a boat of the above mentioned type designed for driving 100 km per hour, the sliding strips 3, 4, 5 may have a length of from 1 to 1–1.5 meter and may have a width of from 80 to 100 millimeters, preferable 90 millimeters if on the boat a foil or slide surface arrangement is provided at the bow and at the stern in conformity with the showing in FIG. 1. A boat of the just mentioned type has been tested at waves having a height up to 1 meter and following closely each other, at the above mentioned speed of 100 km per hour. During this test, no material vibrations and other intolerable hard shocks heretofore common with heretofore known sliding boats of corresponding size have been encountered, but the boat has only carried out soft movements.

Thus, the above test as well as other tests have proved that a boat of the type involved and equipped with the sliding surfaces or sliding foils according to the invention is able to drive at the full speed for which it has been designed without causing inconvenience to the occupants of the boat and without affecting the construction of the boat.

Figure 4:
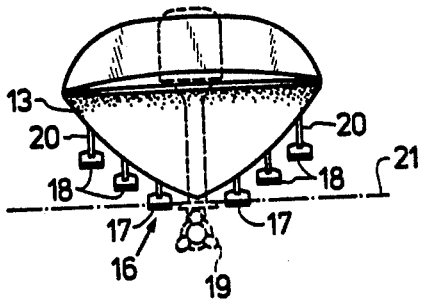
FIG. 4 shows the stern of the boat according to FIG. 3.
Figure 5:
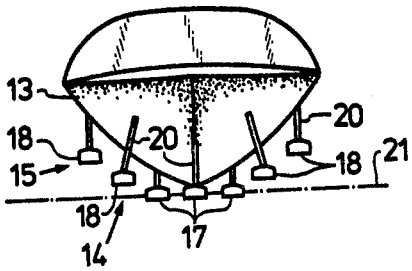
FIG. 5 shows the bow of the boat according to FIG. 3.

Referring now to FIGS. 3 to 5, the modified boat shown therein has its hull 13 which has a V-shaped cross section provided with three groups 14, 15, 16 of sliding strips. The group 14 which is closest to the bow has an inner sliding strip 17 and an outer strip 18 on each side of the bow. The intermediate series 15 comprises two inner sliding strips 17 and on both sides thereof two outer sliding strips 18. The series 16 at the stern has two inner sliding strips 17 and on both sides thereof two outer sliding strips 18. The series 16 lack the intermediate sliding surface in order to leave space for the propeller 19. All sliding strips 17 and 18 are so located that the transverse axis of the sliding surface is parallel to the water surface. The sliding strips 17 and 18 are by means of short spacer webs 20 directly connected to the wall of the hull 13 and its construction. The cross section of these spacer webs is in the driving direction of the boat as narrow as possible in order to offer a minimum flow resistance. Between the sliding strips 17, 18 narrow gaps are open through which the water when being impacted upon the sliding surface can quickly escape and without causing hard shocks.

Sliding foils on each side are longitudinally spaced and aligned longitudinally below the hull.

The outer sliding surfaces 18 may, according to another embodiment of the invention, have the transverse axis of their sliding surface extend parallel to the inclination of the cross section of the hull 13. All sliding surfaces 17 and 18 have a small angle of attack relative to the water surface plane and are resilient in themselves.

When the boat starts, it quickly rises onto the lowermost, which means substantially onto the inner sliding strip 17, in conformity with the dash line 21 of FIG. 3 which represents the water surface at full speed of the boat. When the boat drives straightforwardly, the boat rests on the water with the surface required for the total speed while the sliding strips softly equalize unevenness in the waves and at the same time dampen shocks without the boat being able to rock itself up with regard to encountered shocks. When the boat passes through a curve, the boat will lie on one of its sides while due to the stepped sliding strip arrangement, the necessary impacting surface remains. The stepwise arrangement of the outer sliding strips permits a stable drive through curves at which the boat, similar to heretofore known customary boats with stepped V-cross section will due to the screw lift adapt itself to the curve and will thus retain the same favorable driving properties as with the straightforward drive.

Due to the multiple arrangement of the sliding strip series one behind the other, also shorter as well as longer wave intervals can be equalized with the boat being unable to rock itself up concerning the shocks encountered thereby. The sliding surface arrangements according to FIGS. 3–5 likewise affords a very satisfactory shock absorption while the boat drives softly.

The features of the present invention are directed to a slide surface rather than a sliding boat. The boat formations per se should not be considered to be the subject of the present invention. The water slide surfaces per se are involved with the present invention. Furthermore, the fastening of the individual slide surfaces on boom arms according to FIGS. 1 and 2 should not be considered to pertain to the crux of the present invention. In FIGS. 3–5 there are individual fastenings of the slide surface strips illustrated which would differ from the features shown in FIGS. 1 and 2. The essence of the present invention, however, does not involve such fastenings. Emphasis for the present invention is directed not to the boat but rather the water sliding surface.

It is indifferent and unimportant whether the strips dissolve into the slide surfaces or the slide surfaces dissolve into the strips individually or in groups being connected with the boat body. The inventive concept exists particularly solely in the relationship between the water upper surface and the slide strips. Also, there is without meaning as to the present invention which type of boat is used whether open or closed when becoming supported by the inventive slide surfaces divided into strips. Only the following features are necessary:

1. That the slide surface or slide surfaces stand free or in other words do not form part of the upper surface of the boat body as is the case with conventional slide boats;
2. that the slide surface or slide surfaces would be subdivided into a multiplicity of narrow slide strips lying in travel direction in the longitudinal axis thereof;
3. that these slide strips themselves stand free which means that the same do not engage against a slide surface or against the boat body and that the same can be surrounded by water in the entire extent thereof. This is necessary so that water displaced by the strips can flow unhindered laterally thereof;
4. that the slide strips among themselves leave open gaps extending in a grill or grate manner among themselves extending in travel direction. The slide surface or slide surfaces are dissolved according in a grate or grill of parallel strips so that the water displayed by the strips can escape laterally and upwardly through the grill or grate gap. The slide surfaces need not lie in a plane as illustrated in FIGS. 1–2, but rather the same can be staggered as arranged in different levels according to FIGS. 3–5. This is, however, not dependent upon the form of the boat body. The staggering, however, can occur in accordance with the form of the boat body.

The slide strips can be arranged in groups or individually on support arms or booms of the boat body. However, also this is basically not dependent upon the boat form. The illustrated boat forms and supports or suspensions of the slide strips are only purposeful embodiments which should not restrict or limit the utilization range of the possible embodiments of the features of the present invention.

The form of the boat must be considered to be completely without meaning for the function of the inventive slide surface since this boat configuration during travel upon the slide strips must be considered to be located completely outside of the water. There is purposeful only to select a boat form according to FIGS. 1 and 2 with such slide surfaces because such would be more suitable to plow through greater waves in a frontal manner because minimum resistance would be offered thereby as to greater lateral attacking waves and steep seas. Such a boat would be seaworthy under all conditions.

The slide surfaces described by U.S. Pat. No. 1,630,623-Ludasy issued May 31, 1927, have a width of an estimated 6½ feet (about 2 meters) as can be calculated from a comparison between the machinist illustrated in FIG. 14 and the propeller or tractor (air screw) reproduced therewith that must have a diameter of approximately an estimated 13 feet (about 4 meters). Such a slide surface accordingly would be approximately so large as that of a motor boat or larger. Corresponding thereto also would be the construction shown in FIG. 9 of the cited patent consisting of two Double-T and two U-carriers or supports. Meaningful is also the nominal relationship of length and width of the slide surface illustrated in FIGS. 7 and 8 (approximately 3:1). Such a surface is not comparable with the narrow longitudinal extending individual surface as represented and described with the present invention. It is particularly the essential inventive concept to divide up such wide slide surfaces into narrow individual surfaces in order to make possible an immediate lateral diverting of water upon engagement of the water against the surface. The dangerous and hard impacts which arise with slide boats at high speed and which even make possible higher speed at all during the encountering of waves can be based thereon that underneath the slide surface the water located therebelow at higher speed no longer can be displaced laterally with wide surfaces particularly with the nominal time involved but rather such water becomes caught or trapped under the slide surface and represents an extremely hard resistance. With sufficiently nominal width of the individual slide surfaces, the water can divert laterally so quickly under the slide surface that the hard impacts become avoided. Tests have shown that the width of the slide surfaces cannot be permitted to be greater than approximately 8 inches (20.33 centimeters). Preferably, the same should be about 4" (10.14 centimeters) without consideration as to size or mass of the boat. With larger boats, there are to be arranged therewith correspondingly more slide surfaces of this size or magnitude. The lateral spacing between the slide surfaces cannot be permitted to be too small in order not to hinder a diverting of the water. There has been shown that this spacing should not be greater than approximately 6 inches (15.25 centimeters) and preferably 2" (5.08 centimeters).

The teaching of the cited patent of Ludasy differs from the teaching of the present invention not only by way of the measurement relationship of the slide surfaces. The reduction in size to the aforementioned maximum widths of the partial slide surfaces and the spacing thereof results in an essentially novel effect which previously could not be attained in a different manner. By way of this inventive effect there becomes possible first with the slide boats to travel free of danger and subject to avoiding impacts that cannot be withstood at high speeds of for instance (100 km/Std 0.62 miles per hour) and moreover also to travel when waves are encountered. Thus there exists not only a difference as to magnitude but rather qualitatively and essentially representing a novel invention and greater technical advance.

A further difference of the teaching of the present invention compared with the disclosure of Ludasy consists therein that the slide surfaces thereof must be rigid as proven by the fastening thereof at the forward and rear ends whereas fastenings of the features of the present invention can and should be elastic which can be attained by a middle fastening. Thereby the wave shocks additionally can be absorbed or encountered resiliently.

The vehicle of Ludasy is practically hardly in a position during encountering of waves of high speeds for instance, more than 50 km/Std (31 miles per hour) to travel satisfactorily. The wave shocks or impacts would shatter the linkage or rods which carry the slide surfaces and destroy or bend the moving mechanism thereof.

Upon fastening of the individual surfaces on the boat body, there is of no importance for the present invention whether such would be provided according to FIGS. 1 and 2 or according to FIGS. 3 and 4. The concern involves only that a sufficient spacing exists which means a spacing relative to the boat outer surface in order to provide the water with space to escape laterally. Also, the teaching of U.S. Pat. No. 3,381,920-Berringer issued May 7, 1968, is not comparable with the teaching of the present invention. Only the rear of the under side of the described body 10, 25 should be effective as a water slide surface (column 2, lines 60–63). The same has a greater width therewith than the width of half of the aircraft and would accordingly exist completely contrary to the suggestions of the disclosure of the present invention. The preceding lateral surfaces 20 are narrow only at the rear end thereof but should run in the water and should not serve as slide surfaces. The middle surface 13, however, as shown by FIG. 1 again is too wide so that this would make ineffective the result according to the present invention with which lateral more narrow surfaces are to be provided for effectiveness when such result should arise. Additionally, there is not provided any space for escape of the water in lateral direction since the passages 21 are either filled with water or would fill immediately with water. The requirements of the teaching of the present invention accordingly would not be provided in any event with the disclosure of Ludasy.

The length measurement of the strips or sliding surfaces does not involve the most important consideration, but rather the width of the strips or sliding surfaces must be considered important because the width value is correctly stated in the range of 80–100 millimeters, and this specific value is that which is being emphasized. There cannot be permitted any exceeding width measurement beyond the stated amount within the speed limits obtainable by the boat since otherwise a striking or impacting of the strips occurs when waves are encountered. The specific measured length of the strip surface engaging upon the water is determined according to the weight of the boat and the speed of the boat automatically; such determinative length lies considerably below the stated corrective length of the strip at a value of 1–1.5 meters.

The correct length must be 1–1.5 meters as apparent from the drawings in the case. For example, if the boat is 5 meters long in FIG. 3, accordingly the slide strips are 1.4 meters long. If the boat is 7 meters long in FIG. 1, accordingly the slide strips are 1.5 meters long. The drawings in the case support the relationship of values as disclosed.

There is the narrow cross section perpendicular to the water section and a longer cross section parallel to the water surface.

Neither of the disclosures of Ludasy or U.S. Pat. No. 1,805,184 Donaldson issued May 12, 1930, recognize decisively that the slide strips must be very narrow in order to preclude a hard striking or impacting of the boat upon waves of the water. The springiness or resilience recognized by Donaldson shows that Donaldson did not recognize any way for attaining the success and improvements of the present invention. There is clearly apparent that Donaldson did not have or recognize the features of the present invention, and moreover the Donaldson solution leads away from the features of the present invention. The surfaces of Ludsay are not any slide strips, but rather these slide surfaces are wider than the slide surfaces of normal boats. There is no way obvious from the disclosure of this reference with the size and weight of the boat involved to provide any basis at all for providing a grate or grill of narrow slide strips. Since previously the average man skilled in the art always proceeded on the basis of the question of the possible uplift or buoyancy during calculation of the slide strip surfaces, it must be considered surprising that such strips are not suitable at all to carry or support a boat. The questions of dynamics, especially with respect to the escape of water below the impacting surface previously had been basically neglected. In the creation of the possibility of quick, lateral escape of water there exists the crux of the teaching of the present invention and the cited references do not provide any showing or suggestion pertinent thereto.

There has been conducted continuous tests over a period of many years proceeding from transversely placed wing-typed surfaces and finally developing the inventive strips.

Even at very high speeds far above 50 km per hour, during comparison test demonstration, there is noted that the boat equipped with the inventive slide surfaces travelled smoothly, quietly, and without shocks and impacts while the comparison boat at the same speeds encountered shocks and impacts that could not be withstood. There was shown also that the inventive effect through the lateral discharge or escape of the water under the slide strips was accomplished during engagement thereof in the water. The water can escape or flow away essentially at right angles to the direction of travel with such narrow slide strips and the water can spray up between the slide strips so that during engagement of the strips in the water no essential resistance is encountered. As soon as the slide strips are provided with a greater width, the water can no longer escape or flow away at the higher speeds so that the previously known impacts occur.

It is important that the slide surfaces consist of plural narrow slide strips and the form of the hull of the boat itself is unimportant for the effectiveness of the narrow slide strips and high speed when travelling through water.

The Ludasy reference is over 50 years old and discloses no water surface for sliding boat to travel above 100 km per hour speed capable of encountering hard shocks previously intolerable at high speed for boats occupants. The features of the present invention for the first time made such speeds attainable and tolerable for boat occupants. The supporting members have a free end portion projecting in a cantilever fashion and a plurality of water sliding foils collectively form the sliding surface that stands off leaving gaps between each other in driving direction so that a grate-like structure is formed making it possible when shock waves occur to permit water quickly to flow off laterally and also making possible quick reduction of water pressure which causes the hard shocks. The strips are pivotable about the longitudinal axis and such feature clearly cannot be found in the 50 year old Ludasy and also cannot be found in the 46 year old disclosure of Donaldson. The Donaldson disclosure has been reviewed but nowhere can there be found the specific 80–100 millimeter wide dimension. No basis in fact seems to exist to find 80–100 millimeter wide dimensioning in the 46 year old disclosure.

It is, of course, to be understood that the present invention is, by no means, limited to the specific showing in the drawings, but also comprises any modifications within the scope of the appended claims.

What is claimed is:

1. A body for movement over the surface of the water, said body having a plurality of foil structures for supporting said body on the surface of the water, which are formed of longitudinal foil strips, each strip not exceeding 100 mm. in width and having a length much greater than its width, and extending in the direction of movement, said foil structures including two structures on each side of said body and spaced longitudinally in the direction of movement with the structures on opposite sides transversely spaced, at least two of said structures opposite each other on the opposite sides being adjacent one end of the body, each of said two opposite, transversely spaced structures being formed by a plurality of said foil strips transversely spaced and parallel to each other.

2. A body as claimed in claim 1, in which the foil strips of each foil structure lie in a plane.

3. A body as claimed in claim 1, in which the foil strips have a low angle of attack.

4. A body as claimed in claim 1, in which said foil strips are resilient and are connected at their centers to said body.

* * * * *